United States Patent [19]

Suste

[11] Patent Number: 4,496,879

[45] Date of Patent: Jan. 29, 1985

[54] SYSTEM FOR DRIVING AC PLASMA DISPLAY PANEL

[75] Inventor: Joseph T. Suste, Orange, Calif.

[73] Assignee: Interstate Electronics Corp., Anaheim, Calif.

[21] Appl. No.: 554,176

[22] Filed: Nov. 23, 1983

Related U.S. Application Data

[63] Continuation of Ser. No. 412,205, Aug. 27, 1982, abandoned, which is a continuation of Ser. No. 166,579, Jul. 7, 1980, abandoned.

[51] Int. Cl.[3] ..... H05B 37/00

[52] U.S. Cl. ..... 315/169.4; 315/169.1

[58] Field of Search ..... 315/169.4, 169.1

[56] References Cited

U.S. PATENT DOCUMENTS

| | | | |
|---|---|---|---|
| 3,449,167 | 3/1970 | Baker | 315/169.4 |
| 3,551,721 | 12/1970 | Holz | 315/169.4 |
| 3,868,543 | 2/1975 | Holz et al. | 315/169.4 |
| 3,938,107 | 2/1976 | Criscimagna | 315/169.4 |
| 4,001,636 | 1/1977 | Tottori | 315/169 TV |
| 4,200,822 | 4/1980 | Miller | 315/169.4 |
| 4,316,123 | 2/1982 | Kleen | 315/169.4 |
| 4,333,039 | 6/1982 | Strom | 315/169.4 |

*Primary Examiner*—Harold Dixon

*Attorney, Agent, or Firm*—Knobbe, Martens, Olson and Bear

[57] ABSTRACT

An improvement to sustain drive circuitry for an AC plasma display panel wherein the sustainer signal applied to panel electrodes is simplified to comprise a sequential series of square waves. The actions of writing, selectively erasing and bulk erasing of light emissions in cells of the plasma panel are also performed by combinations of square wave signals generated in sustainer and driver circuits of the device. A combination of integrated circuits comprise both the X and Y axis drivers with the Y axis drivers also including an internally generated Y axis sustain signal onto which Y axis write or erase signals are impressed. The prior art requirement of floating supply voltages is removed and the number of supply voltages is decreased such that all driver and sustainer circuits utilize a common power source, with a maximum of three source voltage levels for operation of all sustainers, drivers, address inputs and logic and timing control of the circuitry. The X axis sustainer may alternatively be comprised of a Mosfet circuit herein disclosed, included two high voltage high current Mosfet transistors connected in a totem pole fashion and operated in a manner which avoids simultaneous conduction of both transistors, thus reducing heat dissipation problems.

18 Claims, 4 Drawing Figures

SUSTAIN
WRITE
ERASE
BULK
X SUSTAINER
90V
30
0V
Y ELECTRODE DRIVER
90V
32
0V
X ELECTRODE DRIVER
90V
0V
34
180V
X SUSTAINER + X DRIVER
90V
0V
36
180V
CELL VOLTAGE
90V
38
0V
-90V
TIME LINE 40
t1
t2
t3
t4
t5
t6
t7
t8
t9
t10
t11
t12
t13
t14
t15
t16
t17
t18
t19
t20
t21
t22
t23

Fig. 3
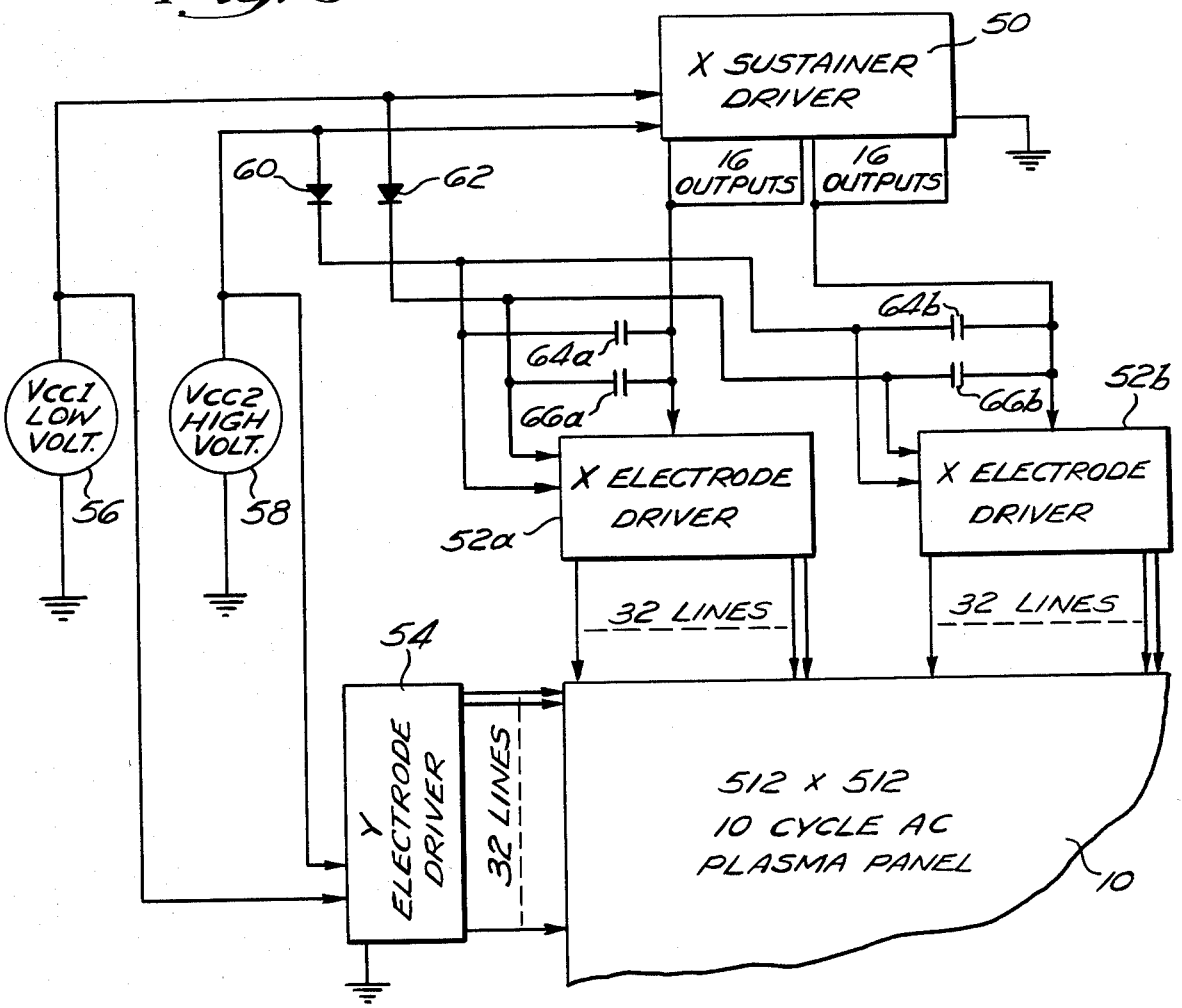
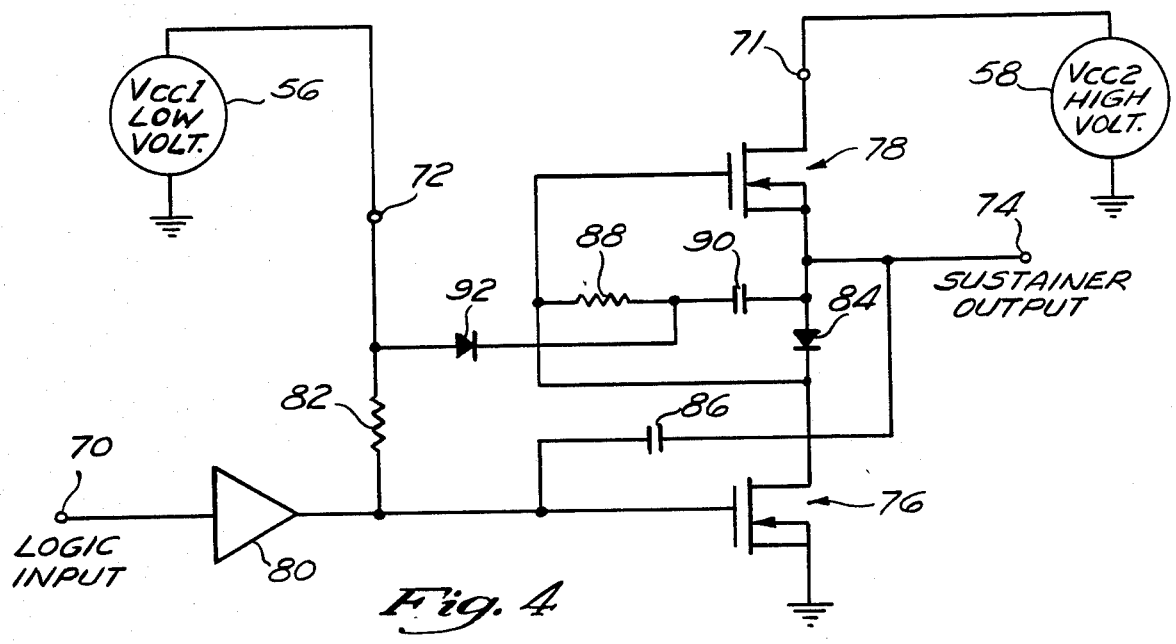
Fig. 4

SYSTEM FOR DRIVING AC PLASMA DISPLAY PANEL

This application is a continuation of U.S. application Ser. No. 412,205, filed 8-27-82 which is a continuation U.S. application Ser. No. 166,579, filed 7-7-80, both now abandoned.

BACKGROUND OF THE INVENTION

Gas plasma panels having an inherent memory were originally disclosed in U.S. Pat. Nos. 3,499,167—Baker et al, and 3,559,190—Bitzer et al. These panels have several inherent advantages over the cathode ray tube display and are presently used commercially, principally as digitally addressable information display devices.

Basically, the panel consists of two glass plates with a gas mixture sealed between them. A plurality of X axis electrodes are deposited on the interior substrate of one plate and a plurality of Y axis electrodes are deposited on the interior of the other plate, thereby providing a plurality of intersecting X and Y electrodes. A voltage of between 200 and 250 volts is required to discharge the gas between intersecting electrodes to emit light at this point. A lesser alternating current voltage will sustain the gas in the light emitting state such that the gas will emit a pulse of light at each transition of the applied AC waveform. A precisely timed, shaped, and phased multiple alternating voltage waveform is required to control the generation, sustaining and erasure of light-emitting gas discharges at the selected locations on the plasma display panel.

Typically, in the prior art systems, a multiple level alternating voltage sustainer drive signal is applied to both the X and Y electrodes so as to present a composite sustainer waveform across the gas at each point or cell in the display panel where the X and Y electrodes intercept. As a result, each of the X and Y electrodes are required to be driven by one of the two separate complex sustainer circuits typically operating at 90 volts. An improvement to this system was disclosed in a U.S. Pat. No. 4,180,762 issued Dec. 25, 1979 by Larry Francis Weber and assigned to Interstate Electronics Corporation. This application discloses a means by which a single sustainer circuit is connected to one axis only of the panel electrodes and accomplishes the sustaining function for all electrodes in the panel.

A further disadvantage of the prior art systems is that they typically require at least seven different voltage levels to be supplied from the power supplies. These various voltage levels are required in order for the circuitry to generate the particular voltage waveforms required to control the generation, sustaining and erasure of light-emitting gas discharges at the selected locations on the plasma display panel. The power dissipated in generating these seven supply voltages, some of which must be adjustable, causes difficulties in packaging and cooling the display.

In addition to power dissipation problems associated with the drive systems, the amount of discrete component circuitry in the power supply and complex sustain voltage generator make these systems costly to produce and test.

SUMMARY OF THE INVENTION

The present invention relates to improved driver circuitry for an AC plasma panel having a number of significant features.

In the preferred embodiment of the invention, the sustain voltage waveform is a simple square wave for the X axis, requiring no additional shaping or pedestals for all display operating modes. This waveform is advantageously generated by the use of integrated circuits or by a simple two transistor circuit. Since there are no complex pedestal shaped waveforms, there is no need to produce the plurality of intermediate voltage levels required in prior art systems. In addition, the control logic is also simplified by virtue of the simplified sustain waveform. Also, the X axis electrode driver outputs are normally in their low (least power) state and only go high for addressing selected electrodes.

Another feature of this invention is that in the address mode, only the addressed cells are supplied an address pulse, with all other cells being supplied the normal sustain voltage levels. As a result, wide, error-free margins can be obtained in contrast to prior art systems in which addressing is accomplished by address modes which partially drive the non-addressed cells.

An additional feature of the preferred embodiment is that the Y axis does not require a separate sustainer circuit since the sustainer function on the Y axis is provided by the Y electrode driver. In addition, these Y axis electrode drivers are ground based (not floating) for ease of entering address data to these devices.

The erase mode of this invention is also entirely novel. The erase waveform provides two erase pulses instead of the single pulse used in the prior art. Only the selected cell or cells are initially pulsed in the positive direction by a selective erase pulse. After this pulse returns to zero, a second non-selective erase pulse in the negative direction causes removal of any wall charge remaining after the selective pulse. This non-selective pulse does not affect any cell which did not receive the initial erase pulse, because the nonselected cells have already been discharged in the negative direction.

A further advantage of the preferred embodiment is that its operating waveforms are such that the sustainer, the X electrode drivers and the Y electrode drivers are powered from a single d.c. voltage supply, thereby further reducing the number of required power supply voltages.

As a result, the present invention substantially simplifies and reduces the problem of manufacturing, testing, packaging and cooling the electronic hardware associated with the power supplies and sustainer and driver circuits.

BRIEF DESCRIPTION OF THE DRAWINGS

FIG. 3 is a circuit schematic depicting the operation of the sustainer driver circuit and both the X and Y axis electrode driver circuits interconnected with the panel electrodes, specifically depicting the integrated circuit driver alternative;

FIG. 4 is a circuit schematic of an alternative X axis sustainer circuit employing MOSFET transistors.

DETAILED DESCRIPTION OF THE PREFERRED EMBODIMENT

OVERALL SYSTEM

Figure 1:
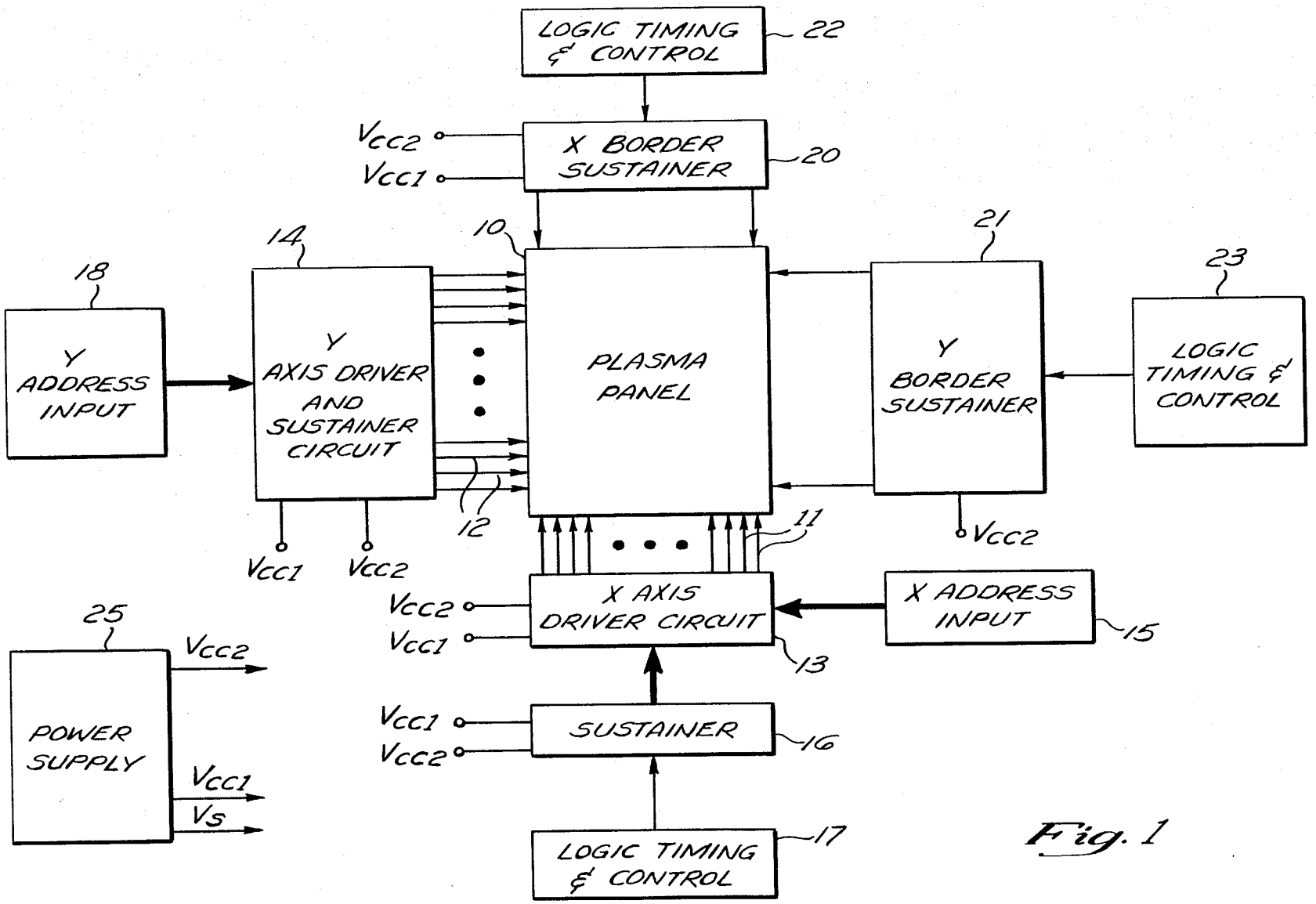
FIG. 1 is a block diagram of the overall system for driving an AC plasma panel in accordance with the present invention.

Referring to FIG. 1, plasma panel 10 is of the AC type with inherent memory as originally disclosed in U.S. Pat. Nos. 3,499,167, Baker et al and 3,559,190, Bitzer et al. Basically this type of plasma panel comprises two glass plates having a gas mixture sealed between them. There are a plurality of vertical electrodes (denoted herein as the X axis electrodes 11) deposited on the interior substrate of one plate and a plurality of horizontal electrodes (denoted herein as the Y axis electrodes 12) deposited on the interior of the other plate, the X and Y electrodes forming a matrix. By way of representative example, such a matrix typically comprises 512 X axis electrodes and 512 Y axis electrodes. The plasma panel 10 has an X axis and a Y axis. The X axis has a plurality of X addresses and X electrodes 11 associated with the X addresses. The Y axis has a plurality of Y addresses and Y electrodes 12 associated with the Y addresses. When the proper voltage waveform is applied to intersecting X and Y electrodes, the gas between the electrodes discharges a bright dot of light at the point or cell of electrode intersection. The charges in the gas gap produce free electrons and gas ions which collect on the walls of the gas cell. This wall charge provides the storage or inherent memory for this type of display. As long as an AC sustaining voltage is applied to the panel, the gas will emit light without further excitation.

The circuitry for exciting any one of the plurality of intersections of the horizontal and vertical electrodes is provided by the X address driver circuit 13 and the Y axis driver and sustainer circuit 14, respectively connected to the X axis electrodes 11 or Y axis electrodes 12. The X axis driver circuit 13 is in turn responsive to an X address input stage 15 and a sustainer circuit 16 which is operatively connected to a plurality of pulse trains provided by a logic timing and control circuit 17. X address input stage 15 identifies the addresses and X electrodes 11 associated therewith.

The Y axis driver and sustainer circuit 14 is responsive to a Y address input stage 18. Y address input stage 18 identifies the Y addresses and Y electrodes 12 associated therewith. A significant feature of the present invention is that the Y axis driver and sustainer circuit 14 internally generates a Y axis sustain signal as part of its function and thereby does not require interconnection with an additional Y axis sustainer circuit.

Y axis driver and sustainer circuit 14 is electrically connected to the Y electrodes 12 associated with Y addresses on the Y axis. Circuit 14 generates Y axis driver and sustainer electrical signals to be applied to the Y electrodes 14. Circuit 14 is connected to Y address input stage 18 so that stage 18 identifies the particular Y electrodes 12 to which the Y axis driver and sustainer electrical signals are applied.

The nature of the plasma panel is such that sustain voltages are applied to the panel borders as a means for priming the plasma cells so that the panel may be reliably written. Accordingly, an X border sustainer circuit 20 is connected to the X axis borders and a Y border sustainer circuit 21 is connected to the Y axis borders. The X border sustainer circuit 20 is driven by pulse trains generated by a logic timing and control circuit 22. The Y border sustainer circuit 21 is driven by logic timing and control circuit 23.

Each of the foregoing described circuits are responsive to one or more of the voltages $V_{CC1}$, $V_{CC2}$, and $V_S$ supplied by power supply 25. By way of specific example, $V_{CC2}$ is 90 volts DC, $V_{CC1}$ is 12 volts DC and $V_S$ is 5 volts DC in an actual display device constructed in accordance with this invention. These three voltage levels are a significant reduction over the seven or more different power supply voltages typically required to operate the prior art systems. In addition, as will be apparent from the detailed description below, no floating power supplies are needed and the overall power requirements of the system are quite modest compared to prior art systems.

SYSTEM WAVEFORMS

Figure 2:
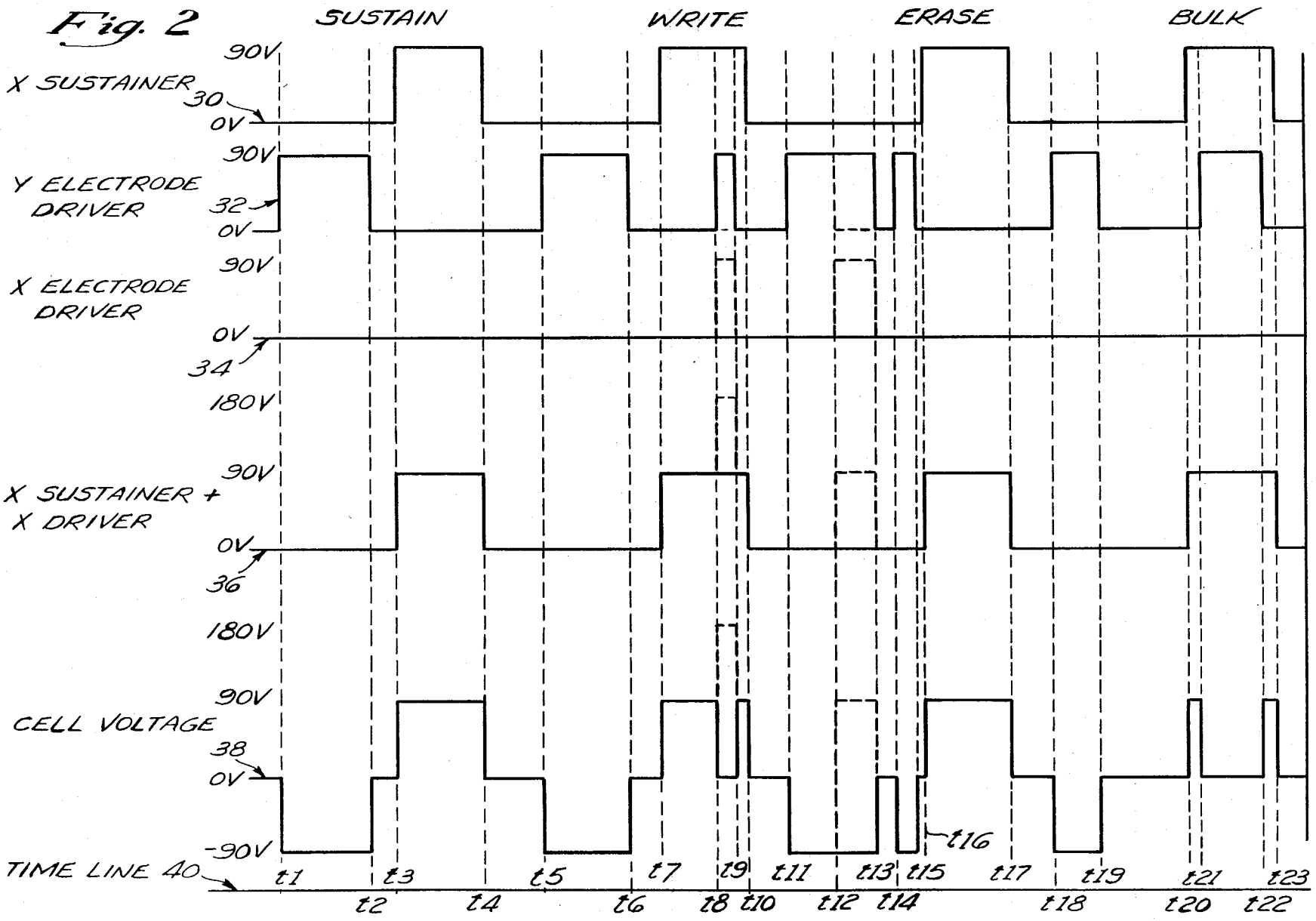
FIG. 2 illustrates the waveforms generated by the X sustainer, the Y electrode driver, the X electrode driver and the resultant operating signals created by combinations of the above waveforms, specifically depicting the operational states of sustain, write, erase and bulk erase.

The X sustainer waveform 30 of FIG. 2 comprises a continuous series of consistently timed square waves which range between a minimum reference voltage to a maximum voltage. In the preferred embodiment, this minimum voltage is ground potential or zero volts with the maximum voltage being 90 volts DC.

Below the X sustainer waveform 30, the other waveforms of FIG. 2 are aligned with the X sustainer waveform 30 according to a time scale 40. The relationship of the various waveforms is described with respect to this time scale 40.

In performing the sustain function only, the X sustainer waveform 30 continues in its previously described square wave operation. The Y electrode driver and sustainer waveform 32 also describes a square wave of similar magnitude to that of the X sustainer waveform 30 but with an opposite phase relationship. Thus, at time T1, Y electrode driver waveform 32 goes from zero volts to 90 volts and remains at that value until time T2 when it returns to its zero value. The X sustainer waveform 30 has remained at its zero value during the period of T1 to T2 but at T3, while the Y electrode drive waveform 32 remains at its 0 level, the X sustainer waveform 30 jumps to its 90 volt maximum value and remains at that value until time T4 when it returns to its 0 volt value. This action continues in the sustain mode with no other action of the electrode drivers beyond that explained.

The resultant cell voltage as seen between the intercepting points of the X and Y electrodes on the plasma panel 10 of FIG. 1 are shown in the cell voltage waveform 38 of FIG. 2. As noted above, the operation of the plasma panel requires that in order to sustain a previously excited cell, a voltage difference of around 180 volts must be seen in an alternating fashion between the intersecting X and Y electrodes. As is apparent in the cell voltage waveform 38, the voltage across the X and Y intersecting electrodes varies from a minus 90 volts to a plus 90 volts which permits the gaseous excitation between said intersecting electrodes to be sustained.

WRITE FUNCTION WAVEFORMS

The act of exciting the gas between two intersecting electrodes in order to cause the emission of light is referred to as writing on a particular cell. In order to accomplish the write function, particular cell locations are identified by the X address input 15 of FIG. 1 and an additional signal is supplied from the Y axis driver and sustainer circuit 14. The waveforms of FIG. 2 show how this write function is accomplished.

At time T7, the sustain waveform of the X sustainer 30 goes to its 90 volt maximum value. At T8, while X sustainer waveform 30 is at its maximum 90 volt value, Y axis driver and sustainer circuit 14 of FIG. 1 emits an additional square wave pulse which also reaches a 90 volt maximum value on all but selected cell locations (represented by the dashed line at 0 volts). Also, at time T8 address input 15 of FIG. 1 causes X axis driver circuit 13 to emit a square wave signal on a selected one or more of the X axis electrodes 11 of FIG. 1 (shown by a dashed line on waveform 34 of FIG. 2). The additional signal emitted by X axis driver circuit 13 of FIG. 1 is added to the voltage level being emitted by the sustainer 16 of FIG. 1 resulting in a waveform depicted at T8 by waveform 36 of FIG. 2. Waveform 38 depicts the cell voltage seen between the intersecting X and Y electrodes at the particular identified location during time T8. The instantaneous voltage difference of 180 volts when applied to the selected cell locations causes excitation of the gas between the two intersecting electrodes resulting in the emission of light at these locations.

After cell excitation has occurred, the Y electrode driver write pulse and the selective pulse on the X electrode driver are removed at T9 causing those voltages to return to 0 and permitting the remainder of the sustain waveform 32 to continue its function and return to 0 volts at T10.

ERASE FUNCTION WAVEFORM

The erase mode of operation is wholly novel in this invention with a combination of waveforms producing two pulses instead of the single pulse used on prior art devices. This is made possible by causing only a selected cell or cells to be pulsed in the positive voltage direction by a selective rectangular wave pulse. After this selective pulse has returned to 0 volts, a non-selective erase pulse is generated in the negative direction causing removal of any wall charge remaining after the selective pulse. This non-selective erase pulse does not affect any cell which did not receive the selective positive pulse because the non-selective cells have already been discharged in the negative direction. This action is explained in more detail by examination of the waveforms of FIG. 2.

At time T11, the Y axis driver and sustainer circuit 14 of FIG. 1 supplies a positive sustain pulse signal as shown by waveform 32 of FIG. 2. At time T12, the Y address input 18 of FIG. 1 causes a selective suppression pulse to be generated by Y axis driver and sustainer circuit 14. This selective suppression pulse has a magnitude of minus 90 volts which is added (inside circuit 14) to the positive 90 volt sustain pulse signal also generated by Y axis driver and sustainer circuit 14 causing a 0 level voltage to be applied to those of the Y axis electrodes 12 which are addressed by Y address input 18. This Y axis sustain pulse signal as suppressed by selective pulses on selected Y axis electrodes 12 is supplied between times T12 and T13 as depicted in the dashed waveform 32 of FIG. 2.

Also at time T12, the X address input 15 causes a rectangular wave erase pulse signal to be generated by X axis driver circuit 13 in a positive voltage direction and applied to selected ones of the X axis electrodes 11 associated with addresses identified by X address input stage 15. The selective pulse of the X axis driver circuit 13 is depicted in the dashed lines between times T12 and T13 on waveform 34 of FIG. 2. The Y axis sustain pulse (shown on waveform 32 of FIG. 2) between time T11 and T13 spans the duration of the X axis erase pulse (shown on waveform 34 of FIG. 2) between times T12 and T13. Note that the Y axis sustain pulse is not applied to Y axis electrodes 12 identified by Y address input stage 18 (as shown by the dashed lines between T12 and T13 on waveform 32 of FIG. 2).

Waveform 38 of FIG. 2 indicates the resultant voltage difference seen between the intersecting X and Y electrodes. Between the unselected electrodes, a normal sustain voltage of minus 90 volts is apparent. However, between the electrodes selected by the X and Y address input stages 15 and 18 of FIG. 1, the dashed waveform 38 of FIG. 2 indicates that a positive 90 volt difference is apparent across the cell corresponding to the intersection of the identified electrodes. This 90 volt difference is removed at time T13 by the removal of the selective pulse at that time. This results in a positive charge remaining upon those particular cell walls identified by the address inputs 15 and 18 of FIG. 1. At time T14 an additional non-selective, rectangular wave, Y axis erase pulse is generated by Y axis driver and sustainer circuit 14 of FIG. 1 as shown on waveform 32. This Y axis erase signal places a negative 90 volts across all cells of the plasma panel 10, as shown on waveform 38. Since the non-specified cells were previously discharged in the negative direction, this additional negative pulse does not have any effect on them. However, the change from the positive to the negative voltage difference across the selective cells removes all wall charges built up by the earlier selective pulse and thus extinguishes light emission from those selected cells. At time T15 the Y axis erase pulse (as shown in waveform 32) is discontinued and the normal sustain mode operation (similar to that shown between times T1 and T5 in FIG. 2) of the apparatus continues.

BULK ERASE FUNCTION WAVEFORMS

Removal of light emission of all cells on plasma panel 10 of FIG. 1 is accomplished by the bulk erase action. This action is depicted on waveform 38 of FIG. 2. From time T18 until T19, the cell voltage is held at −90 volts by the Y electrode driver waveform 32. This signal is removed at time T20 when the Y axis driver and sustainer circuit 14 returns to 0 volts. Circuit 14 subsequently applies a second square wave pulse of 90 volts between times T21 and T22. As a result, T19 cell voltage remains at 0 volts during this interval even though the X sustainer wave is at 90 volts.

The cell voltage as depicted on waveform 38 of FIG. 2 thus remains at 0 after T19, except for an insignificant amount of time between T20 and T21 and between T22 and T23. These short time intervals are not sufficient to sustain the electrical discharge on the panel cells 10 of FIG. 1, resulting in a bulk erase of all electrical signals from all cells of panel 10.

Accordingly, it may be observed that the driver voltage waveforms are simple square waves rather than the complex pedestal waveforms used in the prior art. As will be apparent below, this is a significant advantage in simplifying the driver circuitry.

DETAILED DESCRIPTION OF X AXIS SUSTAINER 16, X AXIS DRIVER CIRCUIT 13 AND Y AXIS DRIVER AND SUSTAINER CIRCUIT 14

Referring to FIG. 3, a portion of the circuitry comprising the X axis sustainer 16 of FIG. 1, the X axis driver circuit 13 and the Y axis driver and sustainer circuit 14 are depicted with their interconnections to the voltage sources from power supply 25 and the electrodes of a typical plasma panel 10 having 512 X electrodes and 512 Y electrodes. The embodiment disclosed in FIG. 3 utilizes integrated circuits to perform the functions of sustainer and electrode driver.

The X sustainer driver 50 of FIG. 3 corresponds to one integrated circuit member of the sustainer circuit 16 of FIG. 1. In order to drive the sustain signal for a 512 X electrode plasma panel, 8 such sustainer drivers are connected in parallel to provide the sustainer circuit 16 of FIG. 1. In this embodiment, each sustainer driver is comprised of a Texas Instruments SN 75501 AC plasma driver, having an output logic level of 12 volts. This driver has 32 output lines, each of which has the ability of controlling the sustainer function on two individual plasma panel electrodes. This device generates a sustain waveform of the type indicated by waveform 30 of FIG. 2. Sustainer circuit 16 generates an X axis sustainer electrical signal having a two level waveform (like that of waveform 30) consisting of a train of pulses.

A plurality of Texas Instruments SN 75501 AC plasma drivers are also used in parallel combination to comprise the Y axis driver and sustainer circuit 14 of FIG. 1. For simplification, only one such integrated circuit stage 54 is shown. For 512 Y electrode panel 10, 16 of these parallel connected circuits are used. This integrated circuit with 32 output lines is interconnected with the Y axis plasma panel electrodes 12 of FIG. 1 by interconnecting individual ones of said 32 outputs with corresponding individual Y axis plasma panel electrodes. Circuit 14 generates Y axis driver and sustainer electrical signals having a two level waveform (like that shown as waveform 32 of FIG. 2) consisting of a train of pulses.

The X axis driver circuit 13 of FIG. 1 is comprised of a plurality of Texas Instruments SN 75500 AC plasma drivers connected in parallel. For simplification, two such integrated circuits stages 52*a* and 52*b* are shown. Integrated circuits such as those shown at 52*a* and 52*b* each consist of semiconductor structures diffused into a silicon substrate and overlaid with metal and glass films. Ordinarily, the circuitry of such an integrated circuit is embedded in a substrate so that the circuitry is referenced to the substrate voltage potential and so that the circuitry may be adjustably biased by adjusting the substrate potential. For a 512 X electrode plasma panel 10, 16 of these parallel connected integrated circuits are used. Each particular device contains 32 output lines, each of which are electrically connected to a corresponding X axis plasma panel electrode 11 of FIG. 1.

As noted above, for simplification, the diagram in FIG. 3 depicts one Y axis driver and sustainer 54, two X axis drivers 52, and one X axis sustainer 50. Depending upon the size of the plasma panel 10, additional integrated circuits are connected in a similar manner as those shown in FIG. 3.

In operation, the X axis sustainer 50 and the Y axis driver and sustainer 54 are both independently connected directly to low voltage source $V_{CC1}$56 and high voltage source $V_{CC2}$58 of power supply 25 of FIG. 1. The first 16 output lines of X sustainer 50 are bussed together and input into the substrate of X electrode driver 52*a* while the second 16 outputs of X sustainer 50 are bussed together and connected to the substrate of X electrode driver 52*b*.

The outputs of X electrode integrated circuit driver stages 52*a* and 52*b* are normally low, i.e., their outputs are connected through their output transistors to their substrate. The X sustainer waveform appears at the outputs of 52*a* and 52*b* which are in turn interconnected to the X axis electrodes 11 of FIG. 1. When it is desired to address the plasma panel display 10, the selected output of X electrode driver 52*a* or 52*b* is turned on by the appropriate signal from X address input 15 of FIG. 1. This raises the potential of that particular output to a voltage level equal to $V_{CC2}$ above the substrate potential. In this manner, the X electrodes are driven with the "X sustain plus X driver" waveform depicted as waveform 36 of FIG. 2. X axis driver circuit 13 generates X axis driver electrical signals having a two level waveform (like that of waveform 36 of FIG. 2) consisting of a train of pulses to be applied to the X electrodes 11 associated with addresses located on the X axis of display 10.

X axis driver circuit 13 is connected to X address input stage 15 so that stage 15 identifies the particular X electrodes 11 to which X axis driver electrical signals are applied. X axis driver circuit 13 is connected to the X axis sustainer circuit 16 so that the electrical summations (like that of waveform 36 of FIG. 2) of the X axis sustainer electrical signal (like that of waveform 30 of FIG. 2) and the X axis driver electrical signal (like that of waveform 34 of FIG. 2) are applied to the respective X electrodes 11 associated with addresses on the X axis of panel 10.

The high voltage inputs of X electrode drivers 52*a* and 52*b* are respectively connected to the high voltage source 58 through diode 60, while the low voltage inputs of X electrode drivers 52*a* and 52*b* are respectively connected to the low voltage source 56 through diode 62. Capacitors 64*a* and 64*b* are connected in shunt fashion between the high voltage inputs of X electrode drivers 52*a* and 52*b* respectively and the corresponding X sustainer driver 50 output bus. Capacitors 66*a* and 66*b* are connected in similar manner, between the low voltage input to X axis electrode drivers 52*a* and 52*b* and the outputs of X sustainer driver 50. All of the above described capacitors have their negative terminals connected to the substrates of the X electrode drivers 52*a* and 52*b* and therefore, when the outputs of the X sustainer driver 50 are at ground potential, the substrates of the X electrode drivers 52*a* and 52*b* are also at ground potential as are the negative terminals of the capacitors just described.

Since the capacitors are connected with their positive terminals through diodes 60 and 62 to the voltage sources 56 and 58, they are charged from those voltage sources when the substrates of X electrode drivers 52*a* and 52*b* are at ground potential. When the X sustainer driver 50 outputs are high (at $V_{CC2}$ potential), the positive terminal of capacitors 64*a* and 64*b* will be at the potential of VCC2 plus VCC2 so that diodes 60 and 62 are reversed biased and no current flows. In this state, power for the internal circuitry of the X electrode drivers 52*a* and 52*b* is supplied by discharging capacitors 64 and 66.

High voltage source 58 supplies a direct current voltage output having a voltage less than the discharge threshold voltage of panel 10. In this preferred embodiment, the voltage output of source 58 is 90 volts. The X axis sustainer circuit 16 is connected to voltage source 58, so that power for X axis sustainer electrical signals (as shown by waveform 30 of FIG. 2) is provided by the output of source 58.

Diode 60 and capacitor 64*a* electrically connect X axis drivers 52*a* to voltage source 58, so that power for X axis driver electrical signals (as shown by waveform 34 of FIG. 2) is provided by the output of source 58. Diode 60 and capacitor 64*a* form a gated hold circuit wherein capacitor 64*a* acts as a means for storing energy. Diode 60 is electrically connected to the output of source 58, and capacitor 64*a* is electrically connected to diode 60 so that capacitor 64*a* may receive power from source 58 when a pulse is not present on the X axis sustainer electrical signal (waveform 30), and capacitor 64*a* may deliver power to X axis driver circuit 52*a* when a pulse is present on the X axis sustainer electrical (waveform 30). Capacitor 64*a* is electrically connected between X axis driver circuit 52*a* and X axis sustainer circuit 50. Diode 60 is electrically connected between source 58 and X axis driver circuit 52*a*.

Diode 60 and capacitor 64*a* also act as a gated hold circuit to gate power into circuit 52*a* from source 58, and to hold power for circuit 52*a* when a pulse is produced by circuit 50. Thus, diode 60 and capacitor 64*a* facilitate the summation of waveform 30 and waveform 34 to produce waveform 36, by providing a floating source of power to circuit 52*a*.

It is important that capacitors 64 and 66 be sufficiently large such that they are not significantly discharged by the power requirements of X electrode drivers 52*a* and 52*b* when diodes 60 and 62 are reverse biased so as to isolate the capacitors 64 and 66 and the X electrode drivers 52 from the power supplies 56 and 58. Capacitors 64*a* and 64*b* must be large enough to respectively supply power to the high voltage circuits of stages 52*a* and 52*b* whenever their substrates are above ground and capacitors 66*a* and 66*b* must supply 12 volt power to these stages under the same circumstance. Also, the current drain on these capacitors must be low enough that these capacitors are not excessively large components. The permissible variation in supply voltage for an X electrode driver 52 is between 10.8 volts and 13.2 volts for the low voltage supply and as much as a volt in either direction in the high voltage supply, without exceeding the addressing margins of a typical plasma display panel. Calculations indicate that if capacitors 64 and 66 are one microfarad each, the voltage drop experienced by one X electrode driver 52 in worst case conditions (when all 32 electrode connected lines are transmitting signals at the same time) causes a change in capacitor voltage of 0.12 volts, which is well within the acceptable limits.

The Y axis driver and sustainer 54 is an integrated circuit identical to that of X sustainer driver 50. The Y axis driver 54 performs a sustain function similar to that of X sustainer driver 50 and it is also responsive to Y address input 18 of FIG. 1 for generation of voltage pulses to selected Y axis panel electrodes.

Since the Y electrode drivers 54 and the X sustainer drivers 50 have their substrates tied directly to the system ground bus, these drivers are ground based. This ground base removes the floating power supply requirement of prior devices and thus removes the extra capacitive load associated with the floating supply. Further, since all of the drivers 50, 52 and 54 use the same supply voltage sources, the power supply needed for this invention is much simpler than for prior art sustainer circuits. The Y axis driver and sustainer circuit 54 are connected to source 58, so that power for the Y axis driver and sustainer electrical signals (waveform 32) is provided by the output of source 58.

In order to accomplish selection of particular plasma panel electrodes for selective signals from drivers 52 and 54, it will be understood that these drivers are supplied with address data. The data entry port of these devices (not shown) is serial, such that the data is shifted into a register within the device and then strobed onto the device outputs at the appropriate time. The data entry port is connected to the appropriate address input circuit 15 or 18 of FIG. 1. The logic system for formating this serial data, routing it to the appropriate electrode driver and providing timing control to strobe the driver for addressing may be the same as that used to control applicant's device disclosed in the above-described U.S. Pat. No. 4,180,762, issued Dec. 25, 1979 by Larry Francis Weber and assigned to Interstate Electronics Corporation.

ALTERNATIVE CIRCUIT FOR SUSTAINER 16 EMPLOYING MOSFET TRANSISTORS

An alternative circuit replacing the plurality of X sustainer integrated circuit driver stages 50 (comprising the sustainer 16 of FIG. 1) has been invented by Larry Frances Weber and is shown in FIG. 4. It is contemplated that a separate co-pending application will be filed having claims specifically directed to this circuit of FIG. 4. However, since the circuit of FIG. 4, when used in combination with the present invention, provides what is presently believed to be the best mode for practicing the present invention, a full description of the circuit and function thereof is included hereinafter.

The circuit of FIG. 4 is designed to perform as the sustainer 16 of FIG. 1 in providing the sustainer output waveform as described in 30 of FIG. 2 for all X axis electrodes 11 of FIG. 1 on a given plasma panel 10. The device shown in FIG. 4 may be substituted for X sustainer driver 50 of FIG. 3 by interconnecting voltage input 71 of FIG. 4 to high voltage source VCC258 and connecting voltage input 72 of FIG. 4 with low voltage VCC156. Additionally, sustainer output interconnection 74 is interconnected to each of the substrate of the X electrode drivers 52 of FIG. 3, and logic input 70 is connected to the data output of the logic timing and control circuit, 17 of FIG. 1.

The X sustainer driver of FIG. 4 comprises two high voltage, high current MOSFET transistors 78 and 76 connected in a totem pole manner as shown in FIG. 4. Transistor 78 is used to charge up the plasma panel to voltage VCC2 and transistor 76 is used to discharge the panel 10 back to 0 volts. Both transistors 78 and 76 are N channel enhancement type MOSFETS. The gates of transistors 78 and 76 are driven by a single open collector TTL logic gate 80 such as SN 7417 or SN 7416. As with the X sustainer driver 50 described previously, the X sustainer driver of FIG. 4 requires only the 12 volt ground base supply voltage for the gate drive.

The gate of transistor 76 is driven by the open collector TTL logic gate 80 output and resistor 82. When the open collector output transistor of the logic gate 80 is off, resistor 82 pulls the gate of transistor 76 to the level of $V_{CCa}$, causing transistor 76 to turn on. This pulls the sustainer output 74 to a ground potential through diode 84.

Capacitor 86 and resistor 82 control the fall time slew rate of the sustainer output 74. Thus, as the sustainer output falls, it forces displacement current through capacitor 86. Most of this current must flow through resistor 82 and therefore, as the output falls, the voltage drop across resistor 82 causes considerably less than the value of $V_{CC1}$ to be measured across the gate of transistor 76. During this output fall, the gate of transistor 76 is typically constant at 5 volts, which causes transistor 76 to act as a constant current source. The plasma panel 10 is thereby discharged with a constant current, resulting in a linearly decreasing ramp voltage. Since a linearly decreasing ramp voltage will also cause a constant displacement current to flow through capacitor 86 which is the condition necessary for the constant 5 volts at the gate of transistor 76, maintained by the ramp voltage which it creates. Using Hitachi 25K134 transistors, this linear ramp discharges the panel in 250 ns using the values of 330 ohms for resistor 82 and 100 pf for capacitor 86.

The state of transistor 78 is controlled through the action of transistor 76. When transistor 76 turns on, it pulls the gate of transistor 78 down to a voltage more negative than that which is present on the source of transistor 78 due to the voltage drop of typically 0.6 volts across diode 84. Since transistor 78 has a very fast switching time, e.g., 5ns, it is turned off almost as soon as transistor 76 conducts so that transistors 76 and 78 are not both conducting at the same time. This fast turn off is of substantial significance in reducing the power dissipated in the MOSFET transistors 76 and 78.

When transistor 76 is turned off, the gate of transistor 78 is charged positive relative to the voltage at its source by resistor 88 and capacitor 90. Transistor 78 then turns on and charges the plasma panel to the voltage $V_{CC2}$.

When transistor 78 is on, its gate is held at a constant voltage level of approximately 11 volts by resistor 88 and capacitor 90. Capacitor 90 is continuously charged to this voltage level as long as the sustainer is pulsing, since capacitor 90 is so charged whenever transistor 76 is on. The current path for the charging of capacitor 90 is from the VCC1 voltage supply 56 through diode 92 to capacitor 90, then through diode 84 and transistor 76 to ground. When transistor 76 is off, capacitor 90 does not charge because the source of transistor 78 is at a voltage level corresponding to $V_{CC2}$ as seen at voltage input 71 and thus diode 92 is reverse biased.

Because of the above-described action, capacitor 90 acts as a floating power supply for the gate of transistor 78. When transistor 78 is on, very little current flows out of capacitor 90 and this current is only due to the leakage currents of diodes 84 and 92, the gate of transistor 78 and the drain of transistor 76. This current amounts to no more than a few microamps, thus permitting capacitor 90 to remain charged for a period much longer than transistor 78 requires to be on for a normal sustain operation. The greatest amount of charge is drawn from capacitor 90 when transistor 76 turns off and transistor 78 turns on, since, at this time, capacitor 90 must charge the gate capacitance of transistor 78 and the drain capacitance of transistor 76. Thus, the value of capacitor 90 should be considerably larger than the sum of these two capacitances. A typical value of 10 microfarads for capacitor 90 has been found to be much larger than is necessary to satisfy these current supply needs.

The turn-on of transistor 78 is controlled in a way that limits the slew rate to a linear rising ramp. This rate of rising is controlled by the resistance value of resistor 88, the source-to-drain capacitance of transistor 76, the voltage across capacitor 90, and the characteristics of transistor 78. Specifically, when transistor 76 is turned off, the gate of transistor 78 is pulled high by resistor 88 and capacitor 90 so that its gate is at a voltage level which is somewhat higher than that present at the source of transistor 78. This condition causes a constant current to flow out of the source of transistor 78 which charges up the plasma panel 10 at a constant rate. Some of this current also flows through capacitor 90 and resistor 88 charging up the drain to source capacitance of transistor 76. Since this capacitance is charged entirely by the current that flows through resistor 88, it is apparent that if the output of the sustainer rises too fast, the voltage across the drain of transistor 76 will not rise as fast. The gate-to-source voltage of transistor 78 will thus be reduced, also reducing the current from the source of transistor 78 and thereby preventing the output of the sustainer from rising too rapidly. A similar situation occurs if the sustain output rises too slowly, but in this case the gate-to-source voltage of transistor 78 increases to compensate for this situation.

It will therefore be seen that the present invention provides a number of distinct advantages over the prior art. The panel sustainer and addressing modes of this invention significantly reduce circuit complexity, power dissipation, and the number of supply voltages. Thus, the power dissipation for systems constructed in accordance with this invention is typically less than 75 watts for a 512×512 AC plasma panel.

Additional features of the invention include a minimum number of discrete components and extensive use of large scale integrated circuits, minimum number of interconnections, no floating power supplies, and a maximum of three power supply voltages.

What is claimed is:

1. A method of erasing a location on an AC plasma panel, said panel having an X axis and a Y axis, said X axis having a plurality of X addresses and X electrodes associated therewith, said Y axis having a plurality of Y addresses and Y electrodes associated therewith, said location being defined by one of said X electrodes and one of said Y electrodes, the method comprising:

generating an X axis erase pulse, and applying said X axis erase pulse to said one X electrode;

generating a Y axis sustain pulse, and applying said Y axis sustain pulse to said plurality of Y electrodes, except, during the duration of said X axis erase pulse, not applying said Y axis sustain pulse to said one Y electrode; and generating a Y axis erase pulse subsequent to said Y axis sustain pulse, and applying said Y axis erase pulse to said plurality of Y electrodes.

2. A method of writing a location on an AC plasma panel, said panel having an X axis and a Y axis, said X axis having a plurality of X addresses and X electrodes associated therewith, said Y axis having a plurality of Y addresses and Y electrodes associated therewith, and said location being defined by one of said X electrodes and one of said Y electrodes, the method comprising:

generating an X axis sustain pulse, and applying said X axis sustain pulse to said plurality of X electrodes;

generating an X axis write pulse while said X axis sustain pulse is being generated, and superimposing said X axis write pulse onto said X axis sustain pulse to obtain a sustain plus write pulse, and applying said sustain plus write pulse to said one X electrode; and generating a Y axis write pulse simultaneously with said X axis write pulse, and applying said Y axis write pulse to said plurality of Y electrodes.

3. A method of writing and erasing an AC plasma display panel having a discharge threshold potential and an inherent memory such that once said discharge threshold potential is exceeded, discharge of said panel is initiated, and said inherent memory permits the discharge of said panel to be sustained by the application of a potential less than said discharge potential, wherein said panel has an X-axis having a plurality of X addresses and X electrodes associated therewith, and a Y-axis having a plurality of Y addresses and Y electrodes associated therewith, and wherein said method comprises:

generating in an X-axis sustainer an X-axis sustainer electrical signal having a high level and a low level, said high level being less than the discharge threshold potential of said panel;

generating in an X-axis driver an X-axis electrical signal having a high level and a low level, each of which is below said discharge threshold potential;

superimposing said X-axis driver electrical signal onto said X-axis sustainer electrical signal to produce a X-axis sustainer plus driver electrical signal, the highest level of which exceeds said discharge threshold potential; and supplying said X-axis sustainer plus driver electrical signal to one of said X-axis electrodes;

generating, in a Y-axis driver and sustainer, Y-axis driver and sustainer electrical signals having a high level and a low level; and supplying said Y-axis driver and sustainer electrical signals to said Y-axis electrodes.

4. The method of claim 3, further comprising:

supplying a direct current voltage less than the discharge threshold potential of said panel to said X-axis sustainer and to said X-axis driver.

5. The method of claim 4, wherein said step of supplying said direct current voltage to said X-axis driver comprises:

supplying said direct current voltage less than the discharge threshold potential of said panel through a diode connected to said X-axis driver and to said energy storage device connected between the output of said X-axis sustainer and said X-axis driver, and storing energy in said energy storage device when said X-axis sustainer electrical signal is at said low level; and delivering power from said energy storage device to said X-axis driver when said X-axis sustainer electrical signal is at said high level to cause said X-axis driver electrical signal to be superimposed on said sustainer electrical signal.

6. The method of claim 5, wherein said step of supplying said direct current voltage to said energy storage device and storing energy comprises supplying said direct current voltage to a capacitor connected between the output of said X-axis sustainer and said X-axis driver.

7. The method of claim 4, further comprising:

supplying said direct current voltage less than the discharge threshold potential of said panel to said Y-axis driver and sustainer.

8. The method of claim 3, additionally comprising combining said X-axis sustainer electrical signal and said X-axis driver electrical signal when said X-axis sustainer electrical signal is at said low level and said X-axis driver electrical signal is at said high level, to generate an erase signal level.

9. The method of claim 3, additionally comprising combining said X-axis sustainer electrical signal and said X-axis driver electrical signal when said X-axis sustainer electrical signal is at said high level and said X-axis driver electrical signal is at said high level, to generate a write signal level.

10. The method of claim 3, wherein the low level of said X-axis sustainer electrical signal is the same as the low level of said X-axis driver electrical signal, and the high level of said X-axis sustainer electrical signal is the same as the high level of said X-axis driver electrical signal.

11. A method of driving an AC plasma display panel having a discharge threshold voltage and an inherent memory, such that once said discharge threshold voltage is exceeded, discharge of said panel is initiated, and said inherent memory permits the discharge of said panel to be sustained by the application of a voltage less than said discharge threshold voltage, wherein said panel is electrically connected to an X-axis sustainer and an X-axis driver, the method comprising:

supplying a direct current voltage having a voltage less than the discharge threshold voltage of said panel to said X-axis sustainer and to said X-axis driver;

producing with said X-axis sustainer an X-axis sustainer signal having a high level and a low level, wherein said high level is less than said discharge threshold voltage;

producing with said X-axis driver an X-axis driver signal having a high level and a low level, wherein said high level is less than said discharge threshold voltage; and superimposing said X-axis sustainer signal and said X-axis driver signal to produce a voltage level higher than any voltage level produced by said power supply, wherein said produced voltage level is also higher than said discharge threshold voltage, to initiate discharge of said panel.

12. The method of claim 11, additionally comprising:

supplying said direct current voltage to an energy storage device connected between said X-axis sustainer and said X-axis driver, and storing energy in said energy storage device when said X-axis sustainer electrical signal is at said low level; and supplying power from said energy storage device to said X-axis driver when said X-axis sustainer signal is at said high level to superimpose said X-axis driver signal onto said X-axis sustainer signal.

13. The method of claim 12, wherein said step of supplying said direct current voltage to said energy storage device comprises supplying said direct current voltage to a capacitor connected between the output of said X-axis sustainer and said X-axis driver.

14. The method of claim 11, additionally comprising combining said X-axis sustainer electrical signal and said X-axis driver electrical signal when said X-axis sustainer electrical signal is at said low level and said X-axis driver electrical signal is at said high level, to generate an erase signal level.

15. The method of claim 11, additionally comprising combining said X-axis sustainer electrical signal and said X-axis driver electrical signal when said X-axis sustainer electrical signal is at said high level and said X-axis driver electrical signal is at said high level, to generate a write signal level.

16. The method of claim 11, wherein the low level of said X-axis sustainer electrical signal is the same as the low level of said X-axis driver electrical signal, and the high level of said X-axis sustainer electrical signal is the same as the high level of said X-axis driver electrical signal.

17. A method of driving an AC plasma display panel having an X-axis and a Y-axis, said X-axis having a plurality of X addresses identifying X electrodes, said Y-axis having a plurality of Y addresses identifying Y electrodes, said method comprising:

sustaining said panel by alternatively, selectively providing a first voltage potential or a second voltage potential on a sustainer output lead; and driving said panel using a driver having said sustainer output lead as its electrical ground input, said driver providing the signal on said sustainer output lead to said panel and selectively superimposing a voltage pulse onto said signal, and supplying the superimposed signal to selected electrodes on said panel.

18. The method of claim 17, additionally comprising supplying said first voltage potential through a diode to said driver and to a first terminal of a capacitor, wherein the other, second terminal of the capacitor is connected to said sustainer output lead.

* * * * *

Disclaimer 4,496,879.—*Joseph T. Suste,* Orange, Calif. SYSTEM FOR DRIVING AC PLASMA DISPLAY PANEL. Patent dated Jan. 29, 1985. Disclaimer filed Dec. 23, 1985, by the assignee, *Interstate Electronics Corp.*

The term of this patent subsequent to Nov. 2, 2000 has been disclaimed.

[*Official Gazette April 1, 1986.*]